US011535282B2

(12) United States Patent
Latourrette

(10) Patent No.: US 11,535,282 B2
(45) Date of Patent: Dec. 27, 2022

(54) MULTI-BUNK RAILCAR FOR TRANSPORT OF METAL COILS

(71) Applicant: STEELSCAPE, LLC, Kalama, WA (US)

(72) Inventor: Brock Allen Latourrette, Brush Prairie, WA (US)

(73) Assignee: STEELSCAPE, LLC, Kalama, WA (US)

( * ) Notice: Subject to any disclaimer, the term of this patent is extended or adjusted under 35 U.S.C. 154(b) by 604 days.

(21) Appl. No.: 16/675,360

(22) Filed: Nov. 6, 2019

(65) Prior Publication Data

US 2021/0129875 A1 May 6, 2021

(51) Int. Cl.
*B60P 7/08* (2006.01)
*B61D 3/16* (2006.01)

(52) U.S. Cl.
CPC ..... *B61D 3/166* (2013.01)

(58) Field of Classification Search
CPC ..... B60P 3/035; B60P 7/12; B60P 7/0892; B61D 3/166; B61D 45/001
USPC ..... 410/36, 47, 48, 49, 50
See application file for complete search history.

(56) References Cited

U.S. PATENT DOCUMENTS 6,077,005 A * 6/2000 Westlake ..... B60P 7/12 410/47
6,846,139 B2 * 1/2005 Al-Kaabi ..... B60P 3/035 410/47
6,923,608 B2 * 8/2005 Rediehs ..... B60P 7/12 410/49
8,342,105 B2 1/2013 Selapack et al.
9,096,238 B2 8/2015 Josephson
9,387,864 B2 7/2016 Lydic et al.
9,862,393 B2 1/2018 Josephson et al.
10,017,191 B2 7/2018 Single
10,300,931 B2 5/2019 Boring et al.
2014/0305332 A1 10/2014 Miller
2015/0232106 A1 2/2015 Boring et al.
2017/0240819 A1 2/2017 Vithani
2017/0217450 A1 8/2017 Thompson et al.
2018/0086354 A1 3/2018 Kress et al.
2019/0135308 A1 5/2019 Single

* cited by examiner

*Primary Examiner* — Stephen T Gordon
(74) *Attorney, Agent, or Firm* — Lathrop GPM LLP

(57) ABSTRACT

A railcar with a plurality of transverse bunks along the railcar body for transporting metal coils. The railcar including a longitudinally extending frame with first and second opposed ends. The railcar also includes a pair of side walls extending the longitudinal length of the railcar and secured to the frame on opposed sides of the railcar, the side walls having an interior and an exterior surface. Each transverse bunk includes at least one bottom plate and first and second canted plates secured to the end edges of the bottom plate. The transverse bunks also utilize a transverse bunk reinforcing member with longitudinally opposed end edges, the reinforcing member welded to and spanning the entire longitudinal length of the lower surface of the first and second canted plates. The longitudinally opposed end edges of the bottom plates, first and second canted plates and bunk reinforcing members are welded to the interior surfaces of the laterally opposed sidewalls.

49 Claims, 11 Drawing Sheets

MULTI-BUNK RAILCAR FOR TRANSPORT OF METAL COILS

TECHNICAL FIELD

This disclosure is directed to a railcar configured for the transport of large metal coils seated within transverse bunks.

BACKGROUND

A subtype to gondola cars, coil cars (a.k.a. "steel coil cars") are a specialized type of freight car designed for transporting coils and/or rolls of sheet metal and steel. These cars can handle a load limit of up to 230,000 pounds based on the 286,000-pound gross rail limit. They first appeared in the 1960s, built for the Pennsylvania Railroad between 1964-65. Each car is equipped with a hood and/or hoods to cover the load. Each hood has a lifting point at its center, and can be stacked when not in use.

Steel Coils have always been difficult to ship. They are extremely heavy, cylindrical in shape, difficult to move, hard to secure, but easy to damage. Traditionally, they have been shipped in a breakbulk fashion. A steel coil is a sheet of steel which has been rolled up. The steel can be of numerous grades or qualities, size and thicknesses or weight. The most common coil might weigh four tons but could weigh nearly twenty-eight tons. Depending on the quality of the metal, the coil may be protected by a cover which is frequently a thin steel sheet. The coil is held together with four to eight steel bands, depending on the size, fastened with clips which have been crimped.

There have been problems when these containers are being transported by rail because the high-frequency vibrations of fast-moving trains stress the railcars and they cannot support the concentrated weight of the coils. As the U.S. Steel industry has traditionally been based in the middle of the country, railroads previously offered specially built rail cars having built-up cradles to transport the coils to seaports for export. The ships in this trade were of the traditional general cargo or breakbulk design. More recently however, the economics of the container trades has changed the method of shipping coils.

The American Associates of Railroads has developed specific regulations that address open top loading that requires the bunk restraint height to be at least thirty percent (30%) of the coil diameter. Most railroads have adopted this rule as well as requirements limiting maximum weight of the coils, and specifics addressing the distribution of the weight and acceptable methods of securing heavy metal coils.

SUMMARY

An embodiment of the railcar disclosed herein includes a plurality of transverse bunks along the car body for transporting a metal coil in each transverse bunk. The railcar includes a longitudinally extending railcar frame with first and second opposed ends and a pair of side walls extending the longitudinal length of the railcar and secured to the frame on opposed sides of the railcar.

Each transverse bunk includes a bottom plate with first and second laterally opposed side edges and longitudinally opposed end edges as well as a bottom plate upper surface and a bottom plate lower surface. The bottom plate extends as a horizontal segment from the second laterally opposed edge to a first line of inflection upwardly to a second line of inflection and then extends more vertically to and terminates at the first laterally opposed edge.

The railcar bunk also includes a side plate with first and second laterally opposed side edges and first and second longitudinally opposed end edges as well as a side plate upper surface and a side plate lower surface. The first laterally opposed side edge of the side plate slightly laps the second laterally opposed side edge of the bottom plate. The side plate extends upwardly proximate the lap from a first line of inflection to a second line of inflection whereupon the side plate extends more vertically and ultimately terminates at the second laterally opposed side edge.

The metal coil transporting rail car also includes a pair of transverse bunk reinforcing members beneath each bunk. These reinforcing members have longitudinally opposed end edges welded to and spanning the entire longitudinal length of the lower surface of the bottom plate and the side plate of each bunk. The longitudinally opposed end edges of the bottom plate, side plate and bunk reinforcing members are welded to the interior surfaces of the laterally opposed sidewalls of the railcar.

It is an object of the multi-bunk railcar for transport of metal coils to increase the load bearing capacity in each of the bunks and to provide maximum restraint of the metal coils in each of the bunks.

It is an object of the multi-bunk railcar for transport of metal coils to satisfy Section 1 of General Rule 5.5 of the Association of American Railroads Open Top Loading Rules Manual that requires the bunk restraint height to be at least thirty percent (30%) of the coil diameter.

It is an object of the multi-bunk railcar for transport of metal coils to provide a design that facilitates the safe transport of coils of many different diameters and weights.

These embodiments are intended to be within the scope of the invention herein disclosed. These and other embodiments of the present invention will become clear to those skilled in the art from the following detailed description of the preferred embodiments having reference to the attached figures, the invention not being limited to any particular preferred embodiment disclosed.

Various objects, features, aspects and advantages of the disclosed subject matter will become more apparent from the following detailed description of preferred embodiments, along with the accompanying drawings in which like numerals represent like components. The contents of this summary section are provided only as a simplified introduction to the disclosure, and are not intended to be used to limit the scope of the appended claims.

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

Figure 1:
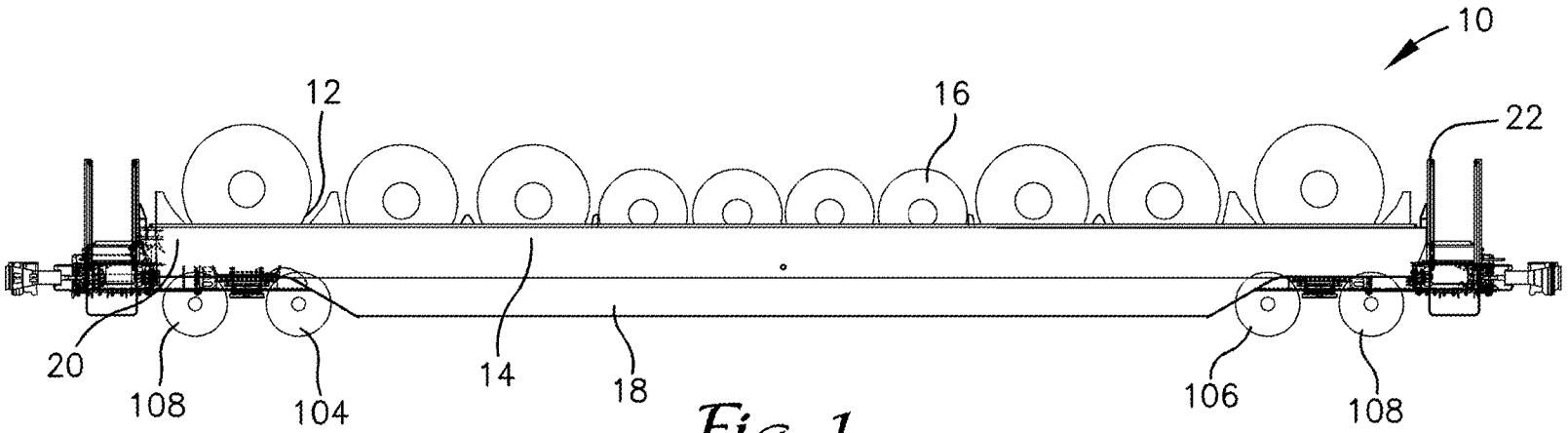
FIG. 1 illustrates a side elevation view of an embodiment of the multi-bunk railcar for transport of metal coils as disclosed herein.

FIG. 1 illustrates an embodiment of the railcar 10 with a plurality of transverse bunks 12 along the car body 14 for transporting a metal coil 16 in each transverse bunk as disclosed herein. The metal coils 16 are fabricated in various sizes, of steel and aluminum and have a wide range of weights associated with each coil. For example, coils can range from 35-84 inches in diameter with widths up to 105 inches and can weigh as much as 80,000 pounds per coil.

Figure 2:
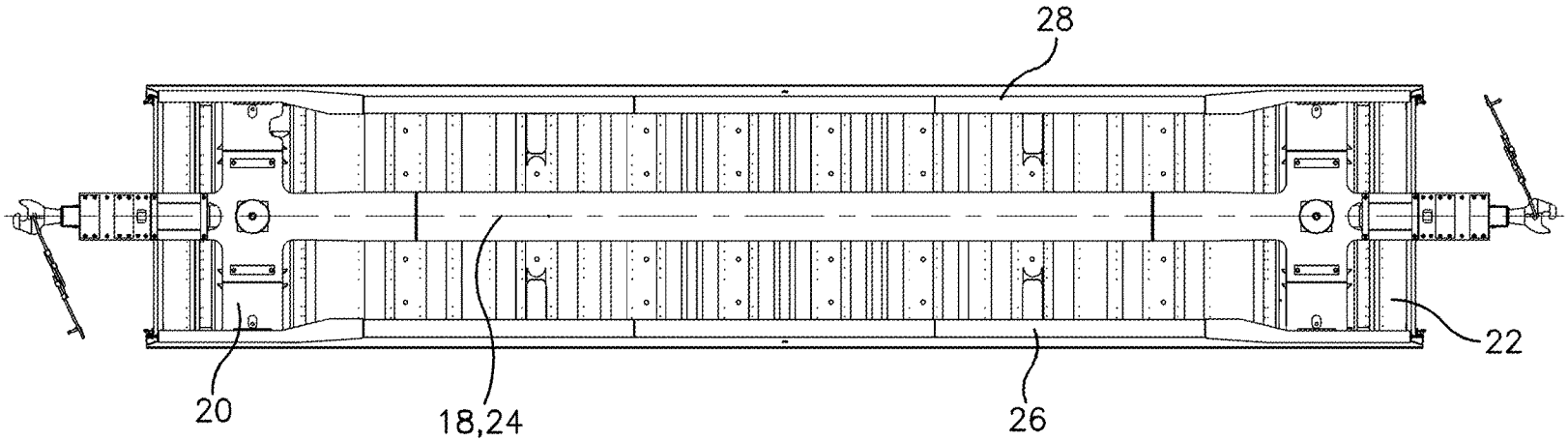
FIG. 2 illustrates a bottom plan view of an embodiment of the multi-bunk railcar for transport of metal coils as disclosed herein.
Figure 3:
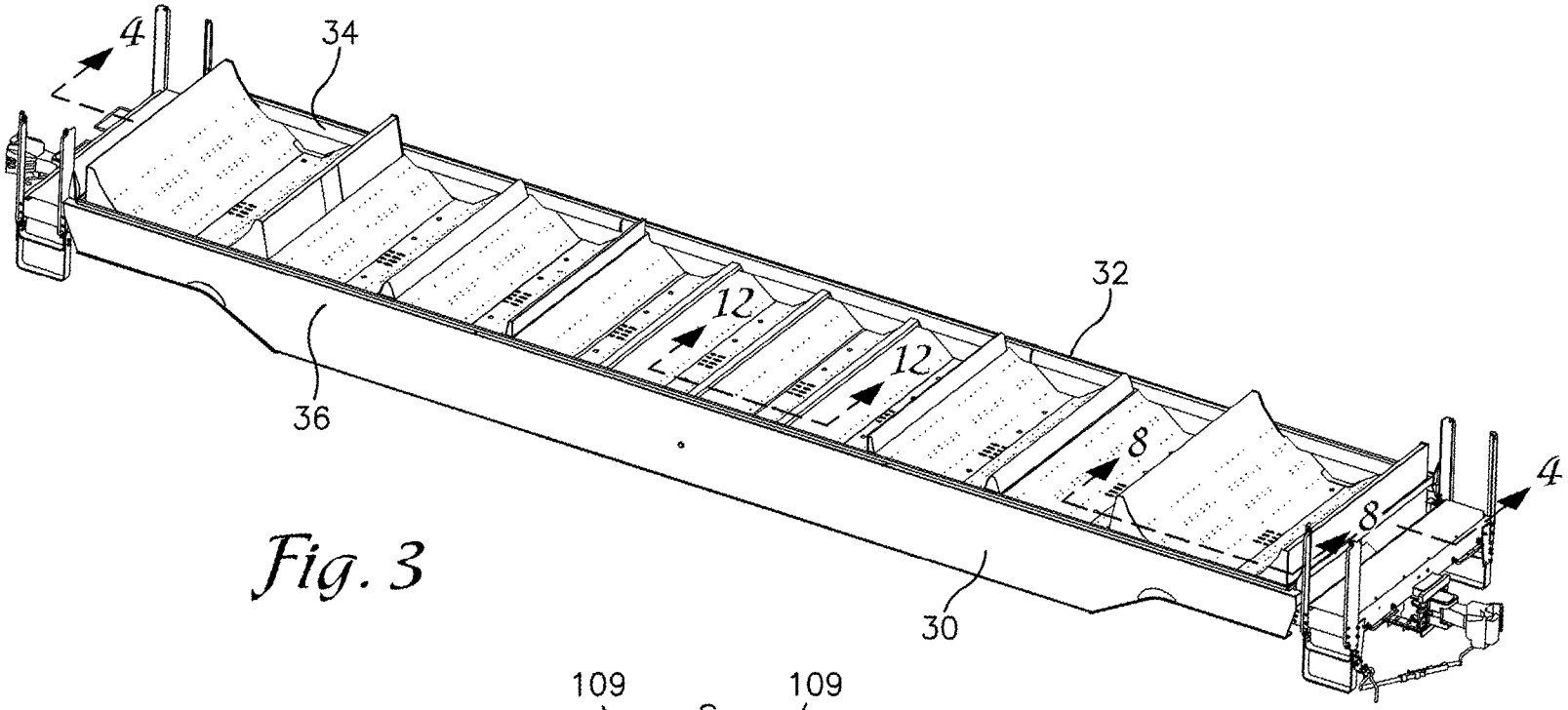
FIG. 3 illustrates a perspective view of an embodiment of the multi-bunk railcar for transport of metal coils as disclosed herein.

As seen in FIG. 2, the underside of the railcar 10 is comprised of a longitudinally extending railcar frame 18 with first and second opposed ends 20, 22 a robust center support member 24 and oppositely disposed side support members 26, 28. The center support member 24 and oppositely disposed side support members 26, 28 are typical in the industry for a railcar that has a carrying capacity of 220,000 pounds. As seen in FIG. 3, the railcar further includes a pair of side walls 30, 32 extending the longitudinal length of the railcar. The transverse bunk walls are at least 3/16-inch thick steel of sufficient tensile strength to restrain lateral movement of the large metal coils that are deposited into the plurality of the bunks 12. The side walls 30, 32 have interior and exterior surfaces 34, 36 and the interior surface 34 of the walls are secured, preferably by welding, to the frame side support members 26, 28 (see FIGS. 2 and 3) on opposed sides 30, 32 of the railcar 10.

Figure 4:
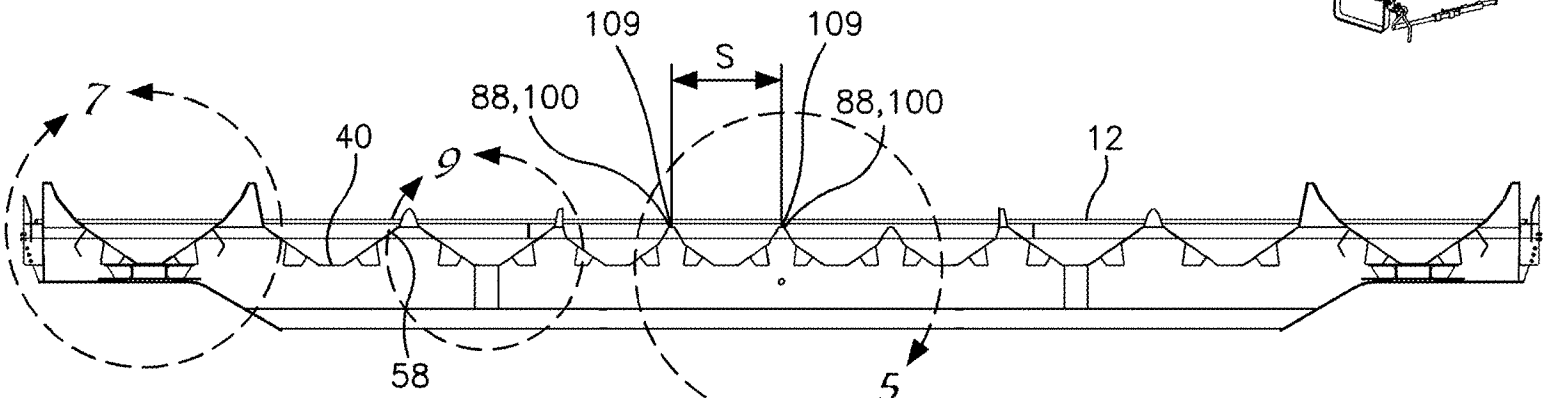
FIG. 4 illustrates a centerline cross-sectional view of the embodiment of the multi-bunk railcar shown in FIG. 3 along section line 4-4.
Figure 5:
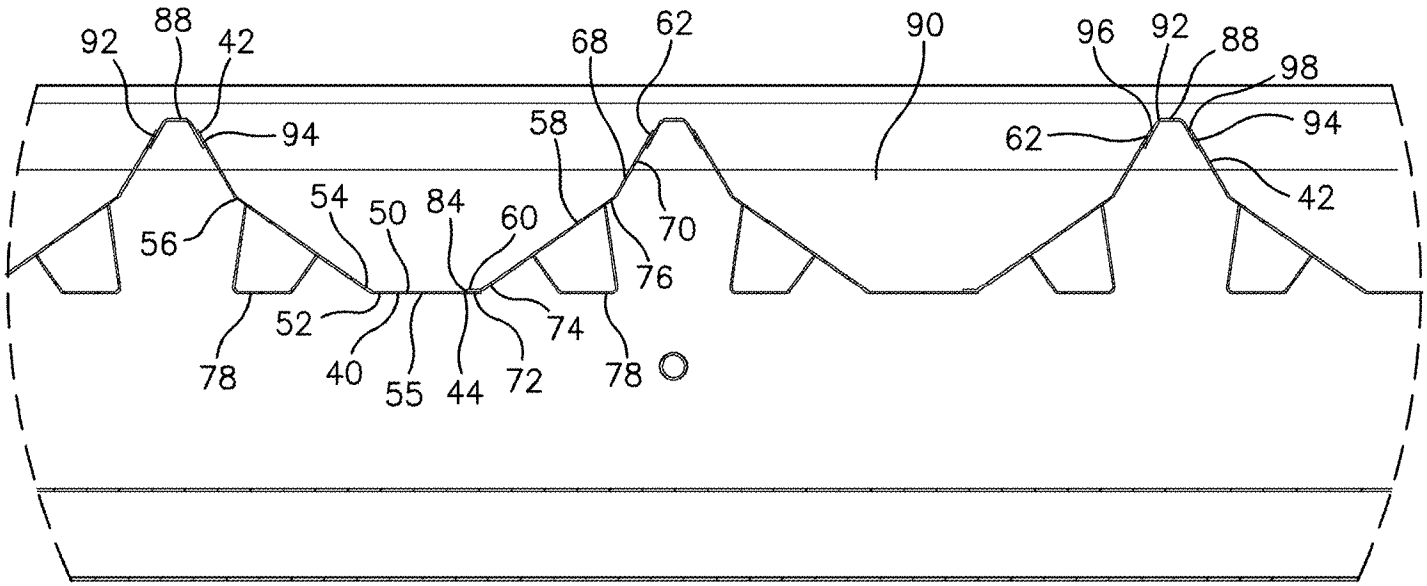
FIG. 5 illustrates sectional view "5" of FIG. 4 of an embodiment of the multi-bunk railcar for transport of metal coils as disclosed herein.

The transverse bunk 12, as seen in the mid-line cross sectional view of the railcar embodiment at FIG. 4 and with greater magnification in FIG. 5, includes a bottom plate 40 with first and second laterally opposed side edges 42, 44 and longitudinally opposed end edges 46, 48 (see FIGS. 6, 6A and 6B) as well as a bottom plate upper surface 50 and a bottom plate lower surface 52. The bottom plate 40 extends as a horizontal segment from the second laterally opposed edge 44 to a first line of inflection 54 upwardly to a second line of inflection 56 and then extends more vertically to and terminates at the first laterally opposed edge 42. A "line of inflection" as used herein is a longitudinally line (extending from sidewall 30 to sidewall 32) about which the steel plate is bent. The bottom plate and all other load bearing plates referenced throughout this specification are preferably fabricated from at least 3/16-inch thick high strength carbon steel.

As further seen in FIG. 5, in this embodiment the transverse bunk 12 also includes a side plate 58 with first and second laterally opposed side edges 60, 62 and first and second longitudinally opposed end edges 64, 66 (see FIG. 6) as well as having an upper surface 68 and a side plate lower surface 70. The first laterally opposed side edge 60 of the side plate 58 slightly laps 72 the second laterally opposed side edge 44 of the bottom plate 40. This lap 72 may be an overlap, or an underlap, whichever the fabricator considers the most efficient for fabrication purposes. The lap is preferably of an inch or more and a weld seam, joining the two lapped surfaces, is run from sidewall 30 to sidewall 32, the entire length of the lap 72. The side plate 58 extends upwardly proximate the lap 72 from a first line of inflection 74 to a second line of inflection 76 whereupon the side plate 58 extends more vertically and ultimately terminates at the second laterally opposed side edge 62.

Figure 6:
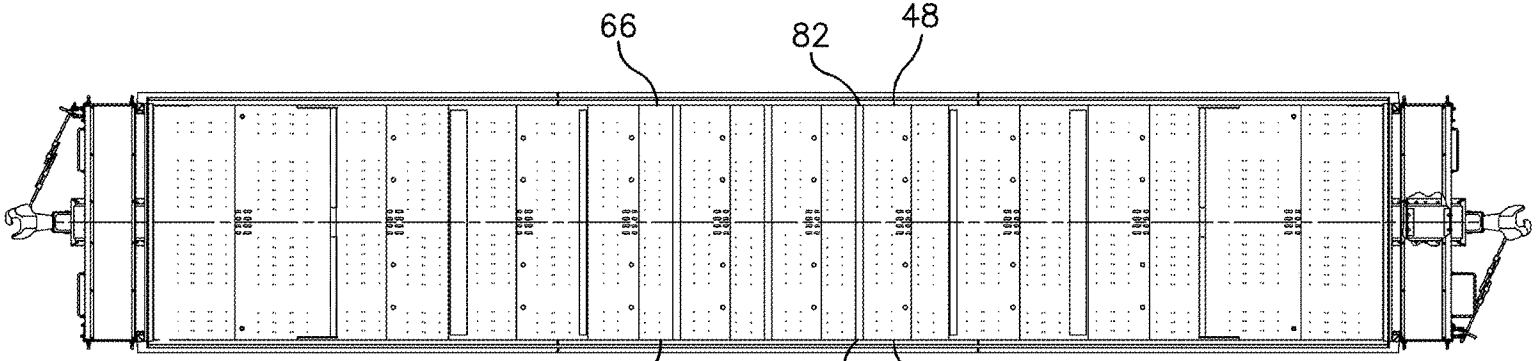
FIG. 6 illustrates a top plan view of an embodiment of the multi-bunk railcar for transport of metal coils as disclosed herein.
Figure 6A:
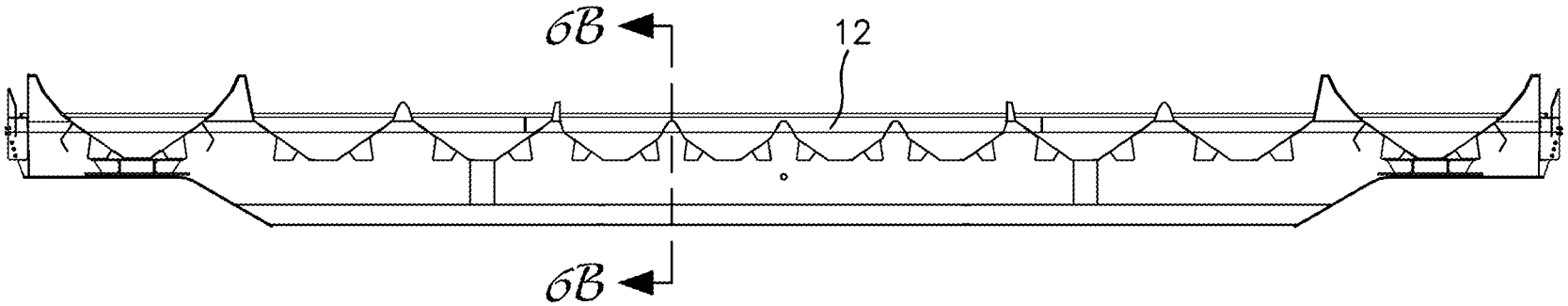
FIG. 6A illustrates a center line cross sectional view along line 4-4 of an embodiment of the multi-bunk railcar for transport of metal coils as disclosed herein.
Figure 6B:
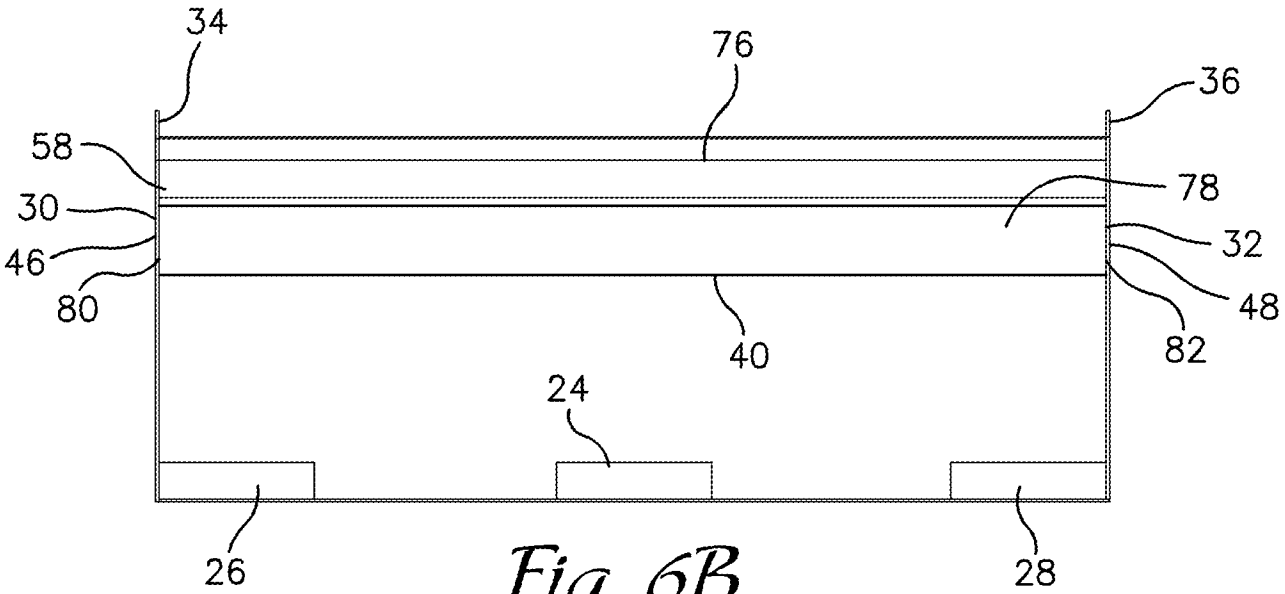
FIG. 6B illustrates a cross sectional view of FIG. 6A at section line 6B-6B of an embodiment of the multi-bunk railcar for transport of metal coils as disclosed herein.

FIG. 5 further reveals a pair of transverse bunk reinforcing members 78 with longitudinally opposed end edges 80, 82, as best seen at FIGS. 6 and 6B. The reinforcing member 78 is a separate member welded to and spanning the entire longitudinal length of each of the lower surfaces of the bottom plate 52 and the side plate 70. As best seen in FIG. 6B, the longitudinally opposed end edges of the bottom plate 46, 48 side plate 64, 66 and bunk reinforcing members 80, 82 are welded to the interior surfaces 34 of the laterally opposed sidewalls 30, 32 thereby providing robust support for the transverse bunks 12 and the heavy coils 16 that are deposited therein. As previously detailed, a weld seam 84 preferably extends longitudinally at the lap 72 of the second lateral edge 44 of the bottom plate 40 and the first lateral edge 60 of the side plate 58.

As further seen in FIG. 5, the bottom plate 40 extends upwardly from the first line of inflection 54 at an angle in the range of about 25-45 degrees from the horizontal segment 55. Likewise, the side plate 58 extends upwardly from the first line of inflection 74 at an angle comparable to the bottom plate in order to maintain an even distribution of the load against the bottom plate 40 and the side plate 58. The bottom plate 40 changes angularity once again at the second line of inflection 56 and increases the upward cant of the plate in the range of about 10-20 degrees. The side plate 58 also changes angularity of the plate at the second line of inflection 76 consistent with that of the bottom plate 40.

As further seen in FIG. 5, between the plurality of transverse bunks 12 where the first laterally disposed end edge 42 of the bottom plate 40 and the second laterally disposed end edge of the 62 of the side plate 58 of an adjacent bunk are in proximity to one another a cap member 88 may optionally be employed. The cap member 88 preferably spans between the first laterally opposed side edge of 42 the bottom plate 40 and the second laterally opposed side edge 62 of the side plate 58 of an adjacent bunk 90.

In at least one embodiment, as seen in FIG. 5, the cap 88 is three sided, trapezoidal in shape, and laps 92, 94 both the first laterally opposed side edge 42 of the bottom plate 40 and the second laterally opposed side edge 62 of the side plate 58 of the adjacent bunk 90. A weld seam 96, 98 is placed at the two lap lines 92, 94 of the cap 88 and the laterally opposed side edges 42, 62 of the bottom plate 40 and the side plate 58. Different configurations of caps are contemplated herein and this description of one embodiment should not be considered limiting. One of the functions of the cap 88 is to limit the intrusion of water between the transverse bunks 12 and, equally as importantly, to elevate the side constraint available for a bunk to prevent movement of the coils should there be a sudden deceleration of the railcar in either direction, such as during an emergency braking maneuver.

As seen in FIG. 1, the railcar frame 18 is supported at the first and second longitudinally opposed ends 20, 22 by a bogie 104, 106. Bogies are typically defined as four wheeled 108 trucks that provide support for the railcar 10. The railcar frame 18 at the first and second ends 20, 22 extends upwardly to provide space for the bogies 104, 106. The operation, positioning and attachment of the bogies 104, 106 being well understood in the industry.

The span "S", as seen in FIG. 4, of a transverse bunk 12 is the distance between a zenith 109 of the cap members 88 associated with each bunk. The transverse bunks 12 at the first and second ends 20, 22 of the frame 18 have a greater span than the adjacent transverse bunks as they are designed to hold larger and heavier coils, including those that are up to 84 inches in diameter.

Figure 7:
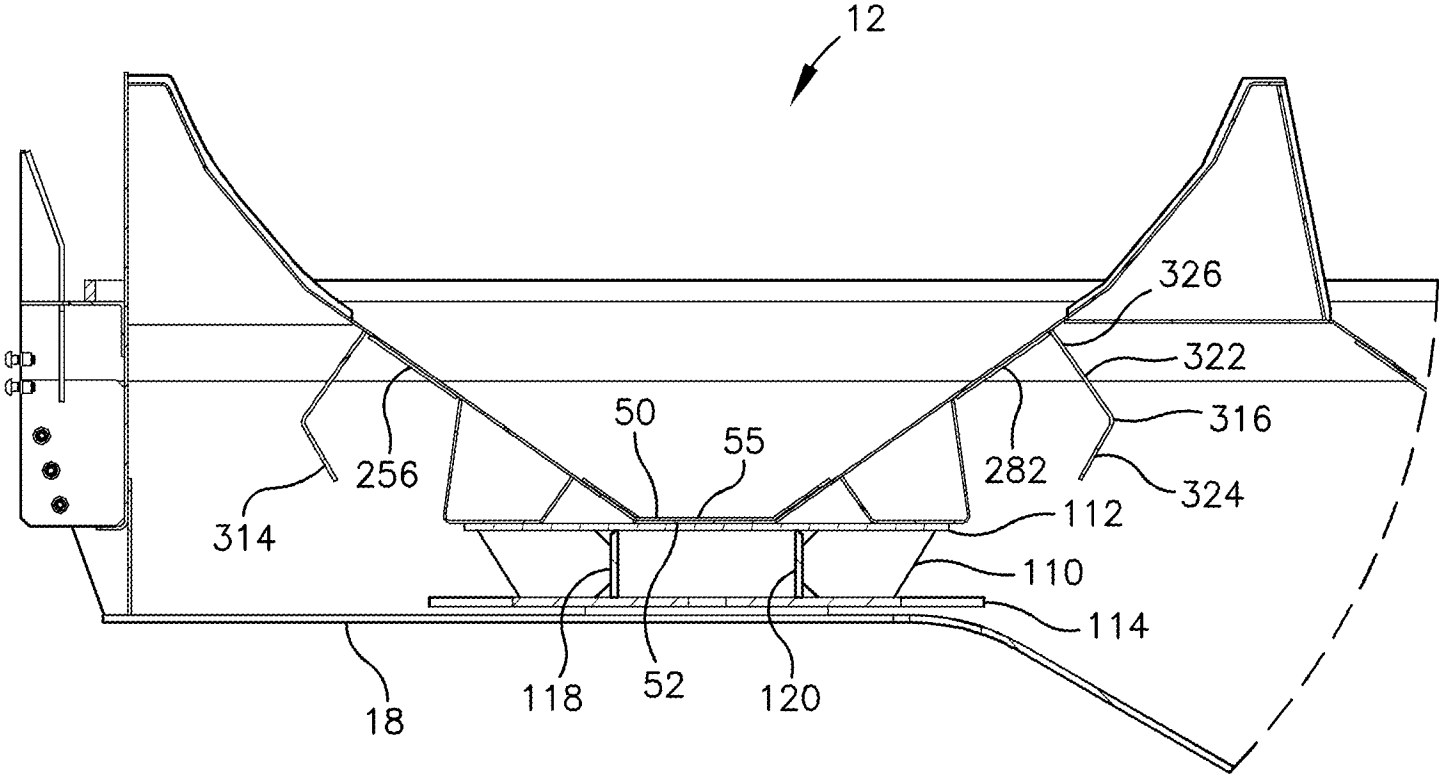
FIG. 7 illustrates segment "7" of FIG. 4 of an embodiment of the multi-bunk railcar for transport of metal coils as disclosed herein.

As seen in FIG. 7 the bottom plates 40 of the larger transverse bunks at the first and second ends 20, 22 of the frame 18 are supported by braces 110 disposed atop the railcar frame 18. Each brace 110 utilizes an upper support plate 112 which resides immediately beneath and contacts the lower surface 52 of the horizontal segment 55 of the bottom plate 40. A lower support plate 114 rests atop the frame 18 of the railcar 10 and the upper and lower support plates 112, 114 are separated by at least two vertically oriented spanner members 118, 120. These braces 110 provide a direct load path to the frame 18 and because of the larger size of the coils 16 that are to be placed in these transverse bunks 12 the braces 110 serve to prevent sagging of the bottom and side plates 40, 58 under the significant load of the large coils.

Figure 8:
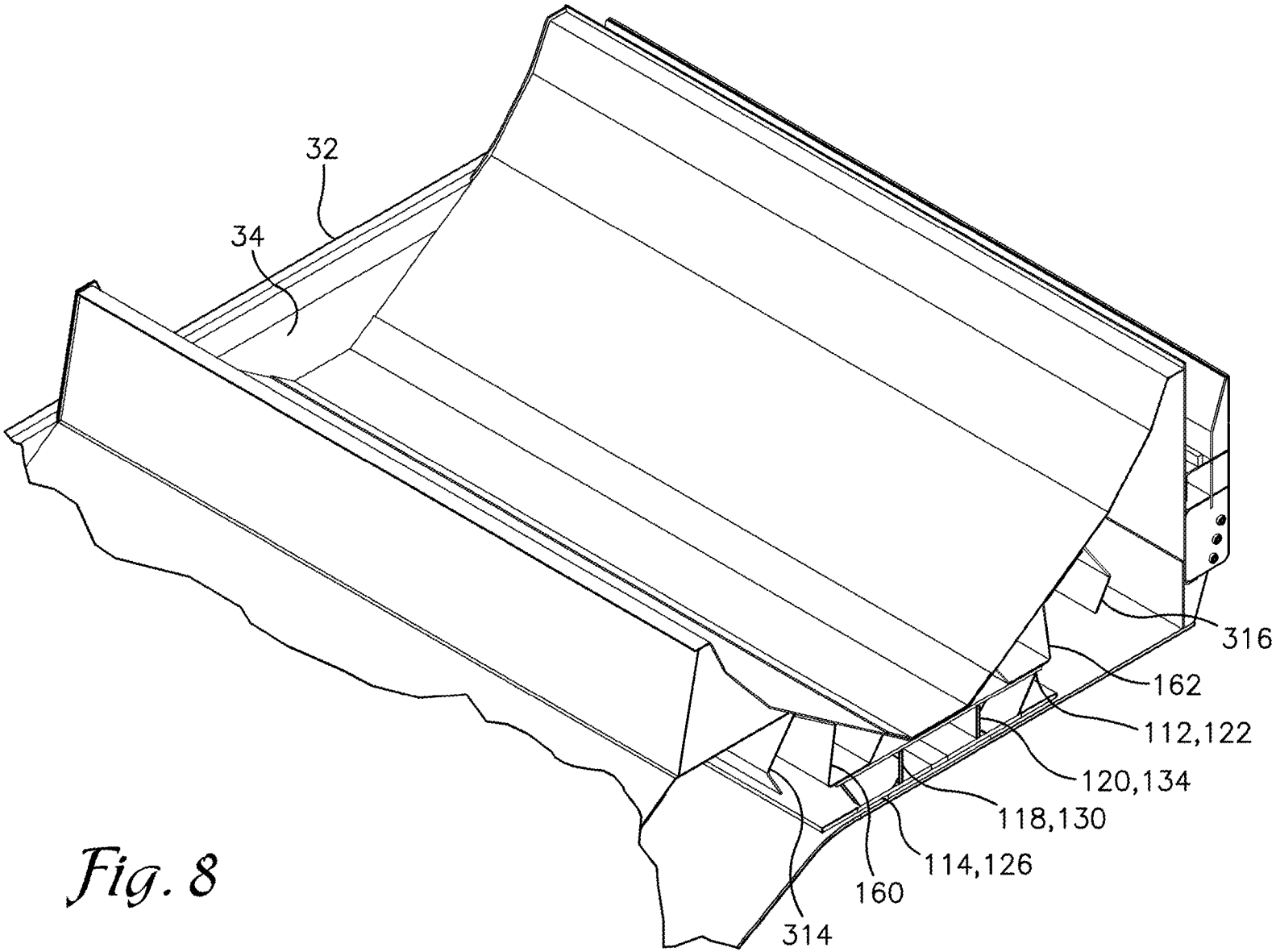
FIG. 8 illustrates a perspective view of FIG. 3 at section line 8-8 of an embodiment of a bunk configuration of the multi-bunk railcar for transport of metal coils as disclosed herein.

As seen in FIG. 8, the longitudinally disposed ends 122, 124 of the upper support plate 112 along with longitudinally disposed ends 126, 128 of the lower support plate 114 as well as the longitudinally disposed ends 130, 132, 134, 136 of the two vertically oriented spanner members 118, 120 are all welded to the interior surface 34 of the sidewalls 30, 32 of the railcar 10. This extensive bracing atop the railcar frame 18 as well as the securing of the longitudinal ends of the various brace members, as detailed above, provides a bunk 12 with robust weight bearing capability.

A bunk restraint height is measured from the upper surface 50 of the bottom plate 40 to the zenith 109 of the cap members 88. According to Section 1 of General Rule 5.5 of the Association of American Railroads Open Top Loading Rules Manual the bunk restraint height must be at least thirty percent (30%) of the coil diameter. In other words, at least thirty percent of the coil diameter must be below the zenith 109 of the cap 88, and as seen on FIG. 4, the cap heights of the bunks vary according to the bunk, to satisfy the minimum safety criteria during coil transport. The thirty percent requirement is intended to reduce the potential for the coil escaping from the bunk during high acceleration/deceleration such as during extreme braking events during which the momentum of the coil seeks to ride up-and-over the walls of the bunk 12. Consequently, raising the zenith 109 of the cap 88 member in some of the bunks 12 may be an appropriate course of action when, during railcar fabrication, it is determined that larger diameter coils 16 will be regularly transported. Cap members 88 of many different elevations and configurations are contemplated by this disclosure.

The bunked railcars 10 disclosed herein, as seen in FIG. 1, preferably employ ten transverse bunks 12; however, the rail cars 10 as disclosed herein may optionally employ fewer bunks 12 with a maximum combined coil weight not to exceed 220,000 pounds. Because the cumulative weight of the coils 16 is so substantial, additional bracing is desired for the bunks 12. As seen in FIG. 4 and at a larger scale in FIG. 9, at least one of the bottom plates 40, and preferably more, are supported by a reinforcing brace 140 with upper and lower edges 142, 144 and longitudinally opposed ends (not shown) that are preferably welded to the interior surface 34 of the sidewalls 30, 32. An optional embodiment may have the reinforcing brace 140 extend only a portion of the longitudinal distance between the sidewalls 30, 32 and not be welded to the walls.

The upper edge 142 of the reinforcing brace 140 is positioned beneath the lower surface 52 of the bottom plate 40 while the lower edge 144 is disposed atop the center support member 24 of the frame 18 and therefore the bunks 12 proximate each reinforcing brace 140 are provided with additional structural support to resist the weight of the coils 16 beyond just the welding of the longitudinally disposed edges 46, 48 of the bottom plates 40 and side plates 58 and transverse bunk reinforcing member 78 longitudinally opposed end edges 80, 82 to the oppositely disposed sidewalls 30, 32.

A wide range of reinforcing brace 140 configurations are contemplated with this disclosure. The brace 140 preferably extends between, and is welded to the side walls 30, 32 of the railcar 10. Alternatively, the brace 140 may only span a portion of the total width of the bottom plate 40 and may terminate the longitudinal ends at an end plate (not shown) which provides additional structural support to the bunk 12.

Figure 9:
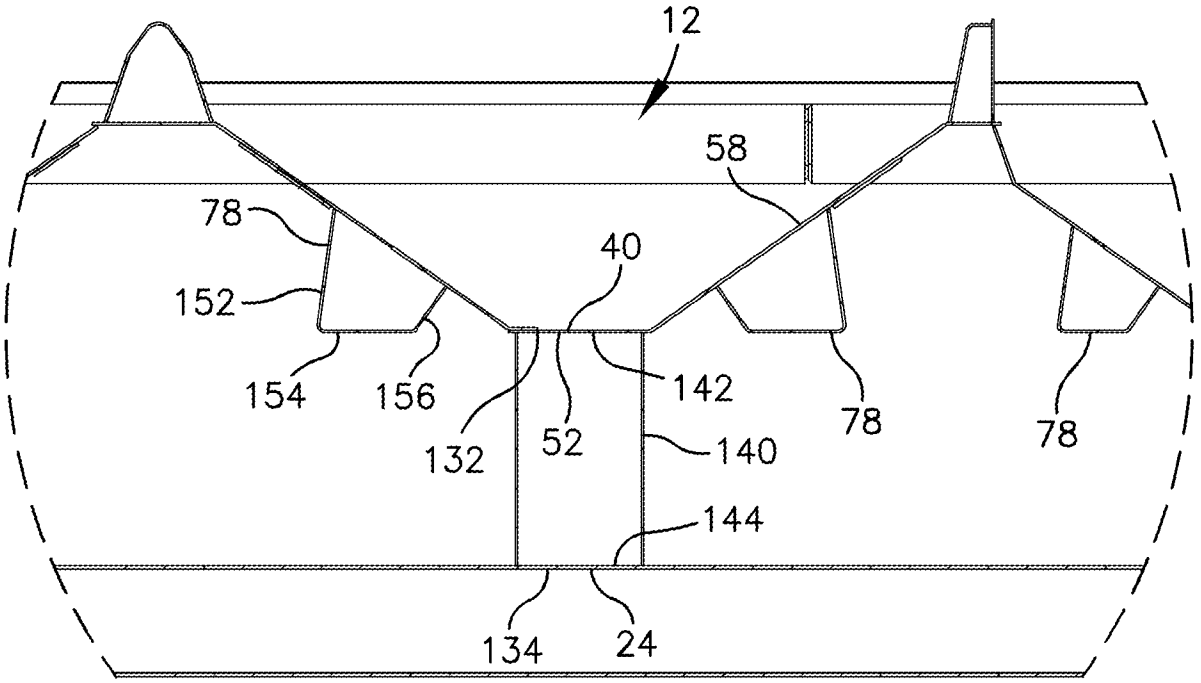
FIG. 9 illustrates a sectional view of segment "9" of FIG. 4 of an embodiment of the multi-bunk railcar for transport of metal coils as disclosed herein.

The transverse bunk reinforcing member 78, as seen in FIG. 5 and as detailed above, provides additional support to the bunk bottom and side plates 40, 58 and facilitates the transport of heavier coils in the bunks 12. A preferred configuration of the reinforcing member 78, as seen in FIGS. 8 and 9, is a three-sided member 152, 154, 156 with the two longitudinally opposed terminal edges 160, 162 of the reinforcing member welded to the interior surface 34 of the side walls 30, 32. The walls 152, 154, 156 of the reinforcing members 78 may be bent to the desired angles from a monolithic plate or alternatively separate plate members may be welded together to form the desired configuration to achieve the reinforcing effect. The transverse bunk reinforcing member 78 may optionally not extend all the way to the sidewalls 30, 32 terminating short of those end points. This of course, will substantially reduce the capacity of the bunk as compared to a reinforcing member with longitudinal edges 160, 162 welded to the interior surface 34 of the side walls 30, 32.

Figure 10:
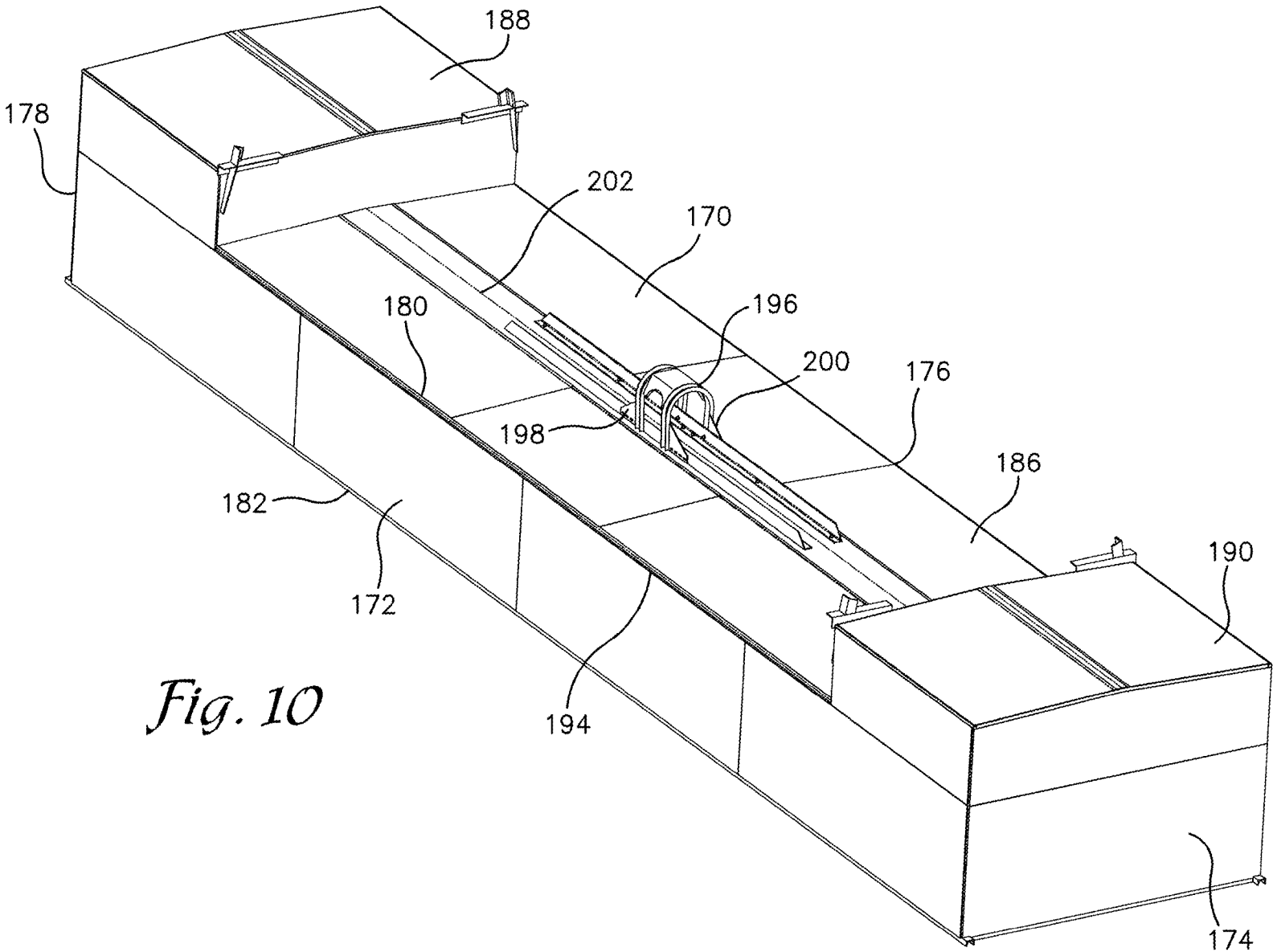
FIG. 10 illustrates a perspective view of an embodiment of the cover assembly of the multi-bunk railcar for transport of metal coils as disclosed herein.

As seen in FIG. 10, the railcar 10 as disclosed herein also includes a removable cover assembly 170 for protecting the metal coils 16 from, for example, vandalism and adverse weather during transit and while waiting for transit at a siding or in a rail yard. The cover assembly 170 includes four vertically oriented skirt panels 172, 174, 176, 178 forming a perimeter around the sidewalls 30, 32 of the railcar 10 when in position. Each of the skirt panels terminates at an upper and a lower edge 180, 182. The cover assembly 170 also includes a cover plate 186 with two elevated sections 188, 190 proximate the first and second ends 20, 22 of the railcar frame 18. The cover plate assembly 170 panels are all preferably fabricated from carbon steel and preferably of a lesser thickness than the material utilized to fabricate the bunks 12 as the cover assembly 170 is not subjected to the considerable loads that will be experienced by the bunks 12. The cover plate 186 has an outer perimeter edge 194 to which the upper edges 180 of the vertically oriented skirt panels is welded.

Figure 11:
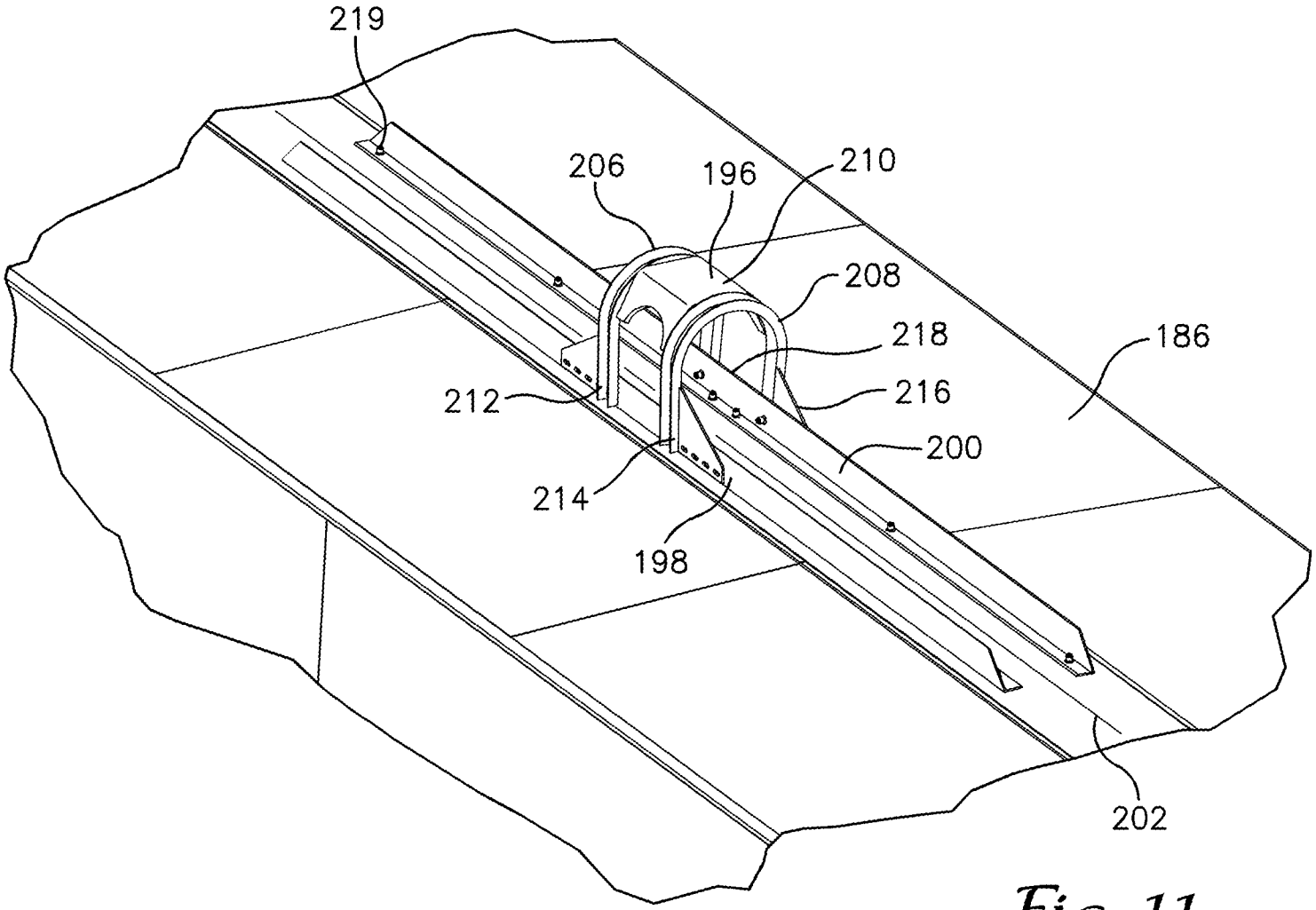
FIG. 11 illustrates a perspective view of an embodiment of the lift assembly of the cover assembly of the multi-bunk railcar for transport of metal coils as disclosed herein.

As seen in FIGS. 10 and 11, the cover assembly 170 also includes a lift bracket 196 that is secured to a pair of cover plate brackets 198, 200 mounted to the cover plate 186 on opposite sides of the midline 202 of the cover plate 186. The lift bracket 196 is preferably fabricated from two inverted U-shaped rib members 206, 208 and an inverted U-shaped web member 210 that spans between the rib members. The rib members 206, 208 each have two lower ends 212, 214, 216, 218. The lower end of each rib member is mounted to the cover plate brackets 198, 200 which in turn are secured to the cover plate 186, preferably with fasteners 219.

Figure 12:
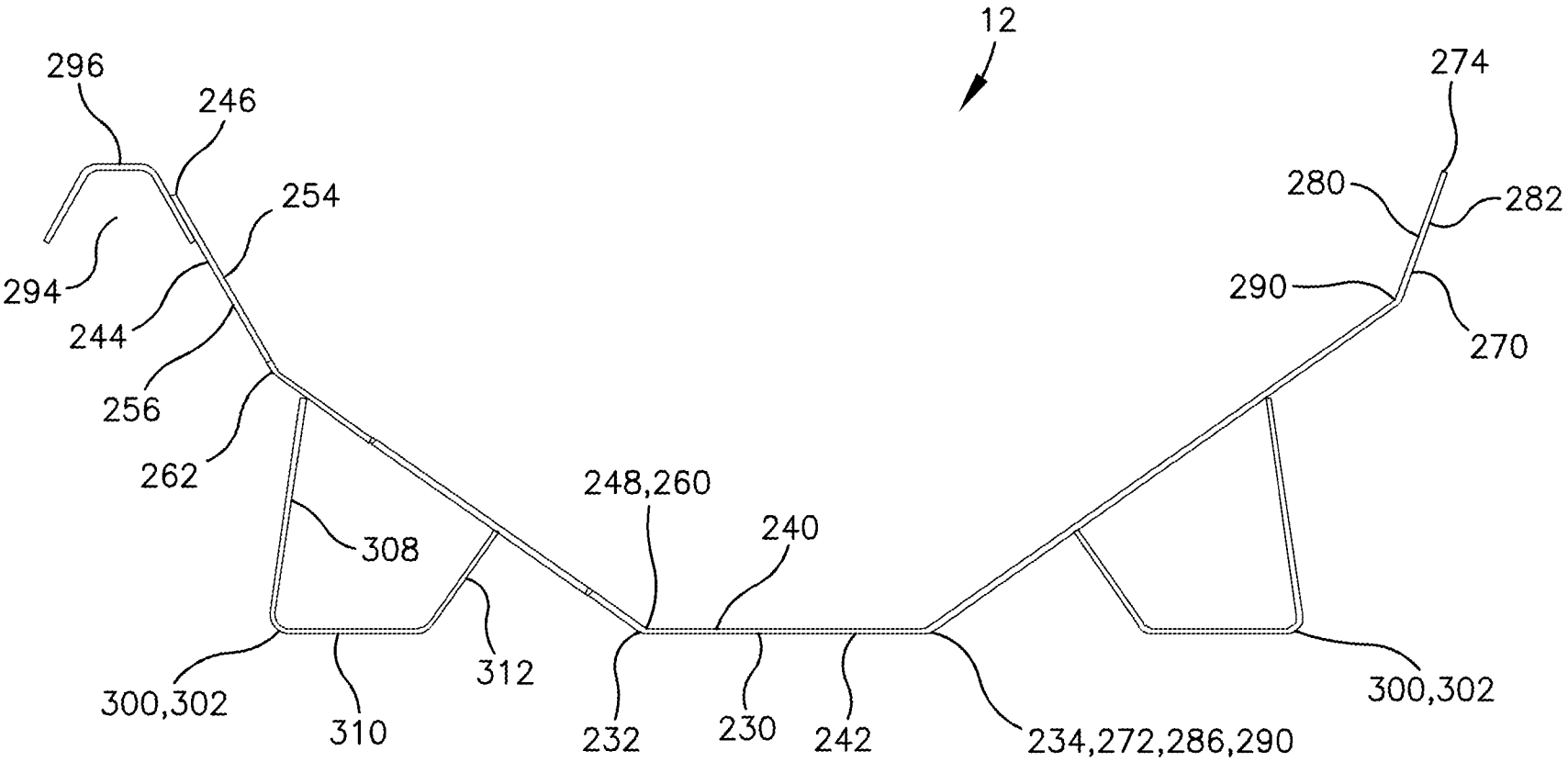
FIG. 12 illustrates a sectional view of FIG. 3 at section line 12-12 of an embodiment of a bunk configuration of the multi-bunk railcar for transport of metal coils as disclosed herein.

In an alternative embodiment of the bunk design, as seen in FIG. 12, each transverse bunk 12 has at least one bottom plate 230 with first and second laterally opposed side edges 232, 234 and longitudinally opposed end edges (not shown) that are secured, preferably by welding, to the interior surface 34 of the side walls 30, 32.

Figure 13:
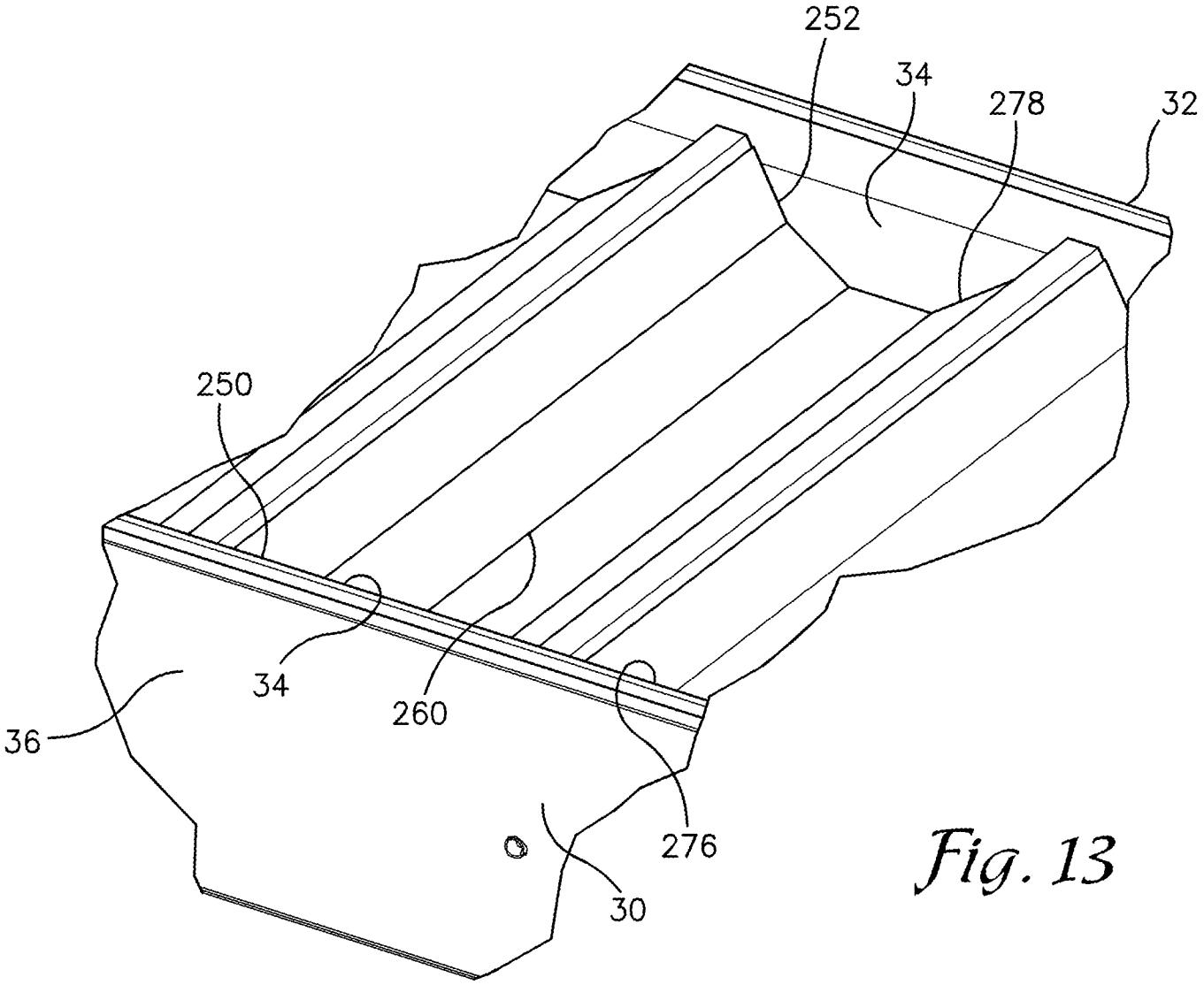
FIG. 13 illustrates a top perspective view of an embodiment of a bunk configuration of the multi-bunk railcar for transport of metal coils as disclosed herein.

This embodiment also includes a first side plate 244 with laterally opposed side edges 246, 248 and longitudinally opposed end edges 250, 252, as seen in FIG. 13, and an upper and lower surface 254, 256. This embodiment connects, preferably with a robust longitudinally extending weld seam 260, the second laterally opposed side edge 248 of the first side plate 244 with the first laterally opposed side edge 232 of the bottom plate 230. The first side plate 244 extends upwardly from the weld seam 260 preferably at an angle in the range of about 25-45 degrees from the bottom plate to a line of inflection 262. The first side plate 244 extends further upwardly from the line of inflection 262 at an angle in the range of about 10-20 degrees before finally terminating at the first laterally opposed side edge 246 of the first side plate 244.

This embodiment of the transverse bunk 12 of the railcar 10 includes a second side plate 270 with laterally opposed side edges 272, 274 longitudinally opposed end edges 276, 278, as seen in FIG. 13, and an upper and a lower surface 280, 282. The first laterally opposed side edge 272 of the second side plate 270 is connected, preferably by a robust longitudinally extending weld seam 286, to the second laterally opposed side edge 234 of the bottom plate 230. The second side plate 270 extends upwardly from the weld seam 286 to the second line of inflection 290. From the weld seam 286 to the second line of inflection 290, the second side plate 270 extends upwardly from the bottom plate 230 at an angle in the range of about 25-45 degrees. The second side plate 270 then extends upwardly from the second line of inflection 290.

Beyond the second line of inflection 290, the second side plate 270 increases the angle of ascent by about 10-20 degrees and terminates at the second side plate lateral edge 274. As with the first embodiment, the bottom plate 230, the first side plate 244 and second side plate 270 are preferably carbon steel and at least 3/16-inch thick to provide sufficient rigidity to support the heavy coils 16 loaded into the bunks 12. This embodiment lacks the overlap of the bottom plate edges with the first and second side plates but may be more expeditiously fabricated since the metal plates do not need the same level of fabrication through bending of the lapping segments. The welds occur at the end edges as opposed to the overlap sections.

As with the first embodiment, the first lateral edge 246 of the first side plate 244 and the second lateral edge 274 of the second side plate 270 of the adjacent bunk 90 are proximate to one another and the gap 294 between the adjacent bunks is covered with a cap member 296. These cap members 296 may be of many different structural configurations and this disclosure should not be considered to limit the scope of the design. Taller cap members may provide greater roll resistance to the coils in the event of an emergency that causes a rapid acceleration or deceleration of the railcar 10 and bunked coil 16.

FIG. 12 is a sectional view of the bunk 12 right at the side member 30. The alternative embodiment of the transverse bunks 12 also utilizes two reinforcing members 300 with longitudinally opposed end edges 302. The reinforcing members 300 are welded to and span the entire longitudinal length of the lower surface 256, 282 of each of the first and second side plates 244, 270. The reinforcing members 300, just as with the first embodiment, are preferably three-sided members 308, 310, 312 that may be formed by bending a plate into a U-shaped configuration, or alternatively, by welding three sections together to form a U-shaped member as seen in the FIG. 12 sectional view.

As seen in FIG. 1 and more fully at FIG. 7, the bunks 12 with the widest span for carrying the largest coils 16 are located over the bogies 104, 106. Because the side plates 244, 270 on these bunks 12 extend upwardly and outwardly a greater distance than side plates of the remaining bunks 12, supplemental reinforcing members 314, 316 are preferably employed to increase the load carrying capacity of the bunks. The supplemental reinforcing members 314, 316 which are welded to the underside 256, 282 of the side plates 244, 270 are preferably fabricated into a wing-shape with two separate plates 322, 324 but additional reinforcing plates may also be utilized to further buttress the first and second side plates. The longitudinally opposed end edges 326 of the supplemental reinforcing members 314, 316 are welded to the interior surface 34 of the sidewalls 30, 32 and increase the load bearing capacity of the wider bunks.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings. Moreover, the order of the components detailed in the system may be modified without limiting the scope of the disclosure.

I claim:

1. A railcar with a plurality of transverse bunks along the car body for transporting a metal coil in each transverse bunk, the railcar comprising:

a longitudinally extending railcar frame with first and second opposed ends;

a pair of side walls extending the longitudinal length of the railcar and secured to the frame on opposed sides of the railcar, the side walls having an interior and an exterior surface;

each transverse bunk comprising:

(a) at least one bottom plate with first and second of laterally opposed side edges and longitudinally opposed end edges as well as a bottom plate upper surface and a bottom plate lower surface;

(b) a first side plate with laterally opposed side edges and longitudinally opposed end edges, a first of the laterally opposed side edges of the first side plate connected to the first laterally opposed side edge of the bottom plate, the first side plate having an upper surface and a lower surface;

(c) a second side plate with laterally opposed side edges and longitudinally opposed end edges, a first of the laterally opposed side edges of the second side plate connected to the second laterally opposed side edge of the bottom plate, the second side plate having an upper and a lower surface; and (d) a transverse bunk reinforcing member with longitudinally opposed end edges and reinforcing member side edges extending transversely across the railcar, the reinforcing member side edges welded to and spanning the entire longitudinal length of the lower surface of each of the first and second side plates;

wherein, the longitudinally opposed end edges of the bottom plate, first and second side plates and bunk reinforcing members are welded to the interior surfaces of the sidewalls.

2. The railcar with the plurality of transverse bunks of claim 1, wherein the first and second side plates extend upwardly from the bottom plate at an angle in the range of about 25-45 degrees from horizontal.

3. The railcar with the plurality of transverse bunks of claim 1, wherein a cap member spans between one of the laterally opposed side edges of the second side plate and ones of the laterally opposed side edges of the first side plate of adjacent ones of the bunks.

4. The railcar with the plurality of transverse bunks of claim 3, wherein the cap laps the laterally opposed side edge of the first side plate and the laterally opposed side edge of the second side plate of adjacent ones of the bunks.

5. The railcar with the plurality of transverse bunks of claim 4, wherein the cap is welded along lines of lap between the cap and side plates of two adjacent ones of the bunks.

6. The railcar with the plurality of transverse bunks of claim 5, wherein a span of one of the transverse bunks is the distance between a zenith of a cap member associated with each bunk.

7. The railcar with the plurality of transverse bunks of claim 1, wherein the railcar frame is supported at the first and second opposed ends by a bogie, each bogie further comprising four wheels.

8. The railcar with the plurality of transverse bunks of claim 1, wherein the railcar frame at the opposed ends extends upwardly to provide space for a bogie.

9. The railcar with the plurality of transverse bunks of claim 8, wherein the bottom plate of the transverse bunk at the first end of the railcar frame is supported by a brace disposed atop the railcar frame.

10. The railcar with the plurality of transverse bunks of claim 6, wherein one of the bunks at the first end of the frame has a greater span than an adjacent one of the bunks.

11. The railcar with the plurality of transverse bunks of claim 6, wherein one of the bunks at the second end of the frame has a greater span than an adjacent one of the bunks.

12. The railcar with the plurality of transverse bunks of claim 1, wherein a bunk restraint height is measured from the upper surface of the bottom plate to a zenith of a cap member.

13. The railcar with the plurality of transverse bunks of claim 1, wherein a bunk restraint height is at least thirty percent (30%) of a coil diameter of one of the metal coils.

14. The railcar with the plurality of transverse bunks of claim 1, wherein there are at least four transverse bunks.

15. The railcar with a plurality of transverse bunks of claim 14, wherein at least one of the bottom plates is supported by a brace with an upper and lower edge and longitudinally opposed end edges of the brace, the upper edge of the brace disposed beneath the lower surface of the bottom plate and the opposed end edges of the brace welded to the sidewalls.

16. The railcar with a plurality of transverse bunks of claim 1, wherein the transverse bunk reinforcing member is a three-sided member with opposed lateral edges and two terminal edges, the opposed lateral edges are welded to the lower surfaces of each of the side plates.

17. The railcar with a plurality of transverse bunks of claim 1, including a removable cover assembly for protecting the metal coils during transit comprising four vertically oriented skirt panels forming a perimeter around the frame and sidewalls of the railcar, each of the skirt panels terminating at an upper and a lower edge.

18. The railcar with a plurality of transverse bunks of claim 17, wherein the cover assembly further comprises a cover plate with two elevated sections proximate the first and second ends of the railcar frame.

19. The railcar with a plurality of transverse bunks of claim 18, wherein the cover plate has an outer perimeter edge to which the upper edge of the vertically oriented skirt panels is welded.

20. The railcar with a plurality of transverse bunks of claim 19, wherein the cover assembly comprises the elevated sections at the first and second ends of the frame of the railcar.

21. The railcar with a plurality of transverse bunks of claim 20, wherein the elevated sections of the cover assembly are disposed over ones of the transverse bunks with the greatest spans.

22. The railcar with a plurality of transverse bunks of claim 19, wherein a lift member is secured to a top surface of the cover plate.

23. A railcar with a plurality of transverse bunks along the car body for transporting a metal coil in each transverse bunk, the railcar comprising:

a longitudinally extending railcar frame with first and second opposed ends;

a pair of side walls extending the longitudinal length of the railcar and secured to the frame on opposed sides of the railcar, the side walls having an interior and an exterior surface;

each transverse bunk comprising:

(a) a bottom plate with first and second laterally opposed side edges and longitudinally opposed end edges as well as a bottom plate upper surface and a bottom plate lower surface, the bottom plate extending as a horizontal segment from the second laterally opposed edge to a first line of inflection upwardly to a second line of inflection and extending more vertically to and terminating at the first laterally opposed edge;

(b) a side plate with first and second laterally opposed side edges and first and second longitudinally opposed end edges as well as side plate upper surface and a side plate lower surface, the first laterally opposed side edge of the side plate slightly lapping the second laterally opposed side edge of the bottom plate, the side plate extending upwardly proximate the lap from a first line of inflection to a second line of inflection whereupon the side plate extends more vertically before terminating at the second laterally opposed side edge; and (c) a transverse bunk reinforcing member with longitudinally opposed end edges, a separate reinforcing member welded to and spanning the entire longitudinal length of the lower surface of the bottom and side plates;

wherein, the longitudinally opposed end edges of the bottom plate, side plate and bunk reinforcing members are welded to the interior surfaces of the sidewalls.

24. The railcar with the plurality of transverse bunks of claim 23, wherein a weld extends longitudinally at a lap line of the second lateral edge of the bottom plate and the first lateral edge of the side plate.

25. The railcar with the plurality of transverse bunks of claim 23, wherein the bottom plate extends upwardly from the first line of inflection at an angle in the range of about 25-45 degrees from the horizontal segment.

26. The railcar with the plurality of transverse bunks of claim 23, wherein a cap member spans between the first laterally opposed side edge of the bottom plate and the second laterally opposed side edge of the side plate of an adjacent one of the bunks.

27. The railcar with the plurality of transverse bunks of claim 26, wherein the cap member laps the first laterally opposed side edge of the bottom plate and the second laterally opposed side edge of the side plate of the adjacent bunk.

28. The railcar with the plurality of transverse bunks of claim 27, wherein the cap member is welded at a lap line of the cap member with the first lateral edge of the bottom plate and at a lap line of the cap member with the second edge of the side plate of the adjacent bunk.

29. The railcar with the plurality of transverse bunks of claim 26, wherein the span of one of the transverse bunks is the horizontal distance between a zenith of the cap members associated with the one of the bunks and an adjacent one of the bunks.

30. The railcar with the plurality of transverse bunks of claim 23, wherein the railcar frame is supported at the first and second opposed ends by a bogie, each bogie further comprising four wheels.

31. The railcar with the plurality of transverse bunks of claim 23, wherein the railcar frame at the first end extends upwardly to provide space for a bogie.

32. The railcar with the plurality of transverse bunks of claim 23, wherein the bottom plate of one of the transverse bunks at the first end of the frame of the railcar is supported by a brace disposed atop the railcar frame.

33. The railcar with the plurality of transverse bunks of claim 29, wherein one of the transverse bunks at the first end of the frame has a greater span than an adjacent one of the transverse bunks.

34. The railcar with the plurality of transverse bunks of claim 29, wherein one of the transverse bunks at the second end of the frame has a greater span than an adjacent one of the transverse bunks.

35. The railcar with the plurality of transverse bunks of claim 23, wherein a bunk restraint height is measured from the upper surface of the bottom plate to a zenith of a cap member.

36. The railcar with the plurality of transverse bunks of claim 23, wherein a bunk restraint height is at least thirty percent (30%) of the coil diameter.

37. The railcar with the plurality of transverse bunks of claim 23, wherein there are at least four transverse bunks.

38. The railcar with a plurality of transverse bunks of claim 37, wherein at least one of the bottom plates is supported by a brace with an upper and lower edge and longitudinally opposed end edges, the upper edge of the brace disposed beneath the lower surface of the bottom plate and the opposed end edges welded to the sidewalls.

39. The railcar with a plurality of transverse bunks of claim 23, wherein the transverse bunk reinforcing member is a three-sided member with two laterally opposed side edges welded to the lower surfaces of each of the bottom plate and side plate.

40. The railcar with a plurality of transverse bunks of claim 23, including a removable cover assembly for protecting the metal coils comprising four vertically oriented skirt panels forming a perimeter around the frame and sidewalls of the railcar, each of the skirt panels terminating at an upper and a lower edge.

41. The railcar with a plurality of transverse bunks of claim 40, wherein the cover assembly further comprises a cover plate with two elevated sections proximate the first and second ends of the railcar frame and the cover plate further comprises a longitudinally extending midline.

42. The railcar with a plurality of transverse bunks of claim 41, wherein a lift bracket is mounted to a pair of cover plate brackets mounted to the cover plate on opposite sides of the midline of the cover plate.

43. The railcar with a plurality of transverse bunks of claim 41, wherein the cover plate has an outer perimeter edge to which the upper edge of the vertically oriented skirt panels is welded.

44. The railcar with a plurality of transverse bunks of claim 41, wherein the cover assembly comprises the elevated sections at first and second longitudinally disposed ends of the railcar.

45. The railcar with a plurality of transverse bunks of claim 44, wherein the cover assembly elevated sections are disposed over ones of the transverse bunks with the greatest spans.

46. The railcar with a plurality of transverse bunks of claim 42, wherein the lift bracket is comprised of two inverted U-shaped rib members and an inverted U-shaped web member.

47. The railcar with a plurality of transverse bunks of claim 46, wherein each rib member has two lower ends.

48. The railcar with a plurality of transverse bunks of claim 47, wherein the U-shaped web member spans between and connects the two inverted U-shaped rib members.

49. The railcar with a plurality of transverse bunks of claim 48, wherein at least one of the lower ends of each rib member is mounted to the cover plate brackets.

* * * * *